United States Patent [19]

Botvin

[11] 4,017,949

[45] Apr. 19, 1977

[54] METHOD OF MAKING A SCOURING PAD OR THE LIKE

[75] Inventor: George B. Botvin, Cumberland, R.I.

[73] Assignee: ACS Industries, Inc., Woonsocket, R.I.

[22] Filed: Feb. 27, 1975

[21] Appl. No.: 553,509

[52] U.S. Cl. ..... 28/77; 15/209 B; 66/9 A

[51] Int. Cl.[2] ..... D05B 1/08

[58] Field of Search ..... 28/77; 66/9 A, 169, 66/170, 190; 15/209 B, 222

[56] References Cited

UNITED STATES PATENTS

| | | | |
|---|---|---|---|
| 1,533,868 | 4/1925 | Kingman | 66/170 X |
| 1,658,048 | 2/1928 | Herzfeld | 66/170 |
| 2,421,357 | 5/1947 | Saftlas | 66/170 |
| 2,425,293 | 8/1947 | McDermott | 66/9 A |
| 2,601,771 | 7/1952 | Cameron | 66/170 |
| 3,252,176 | 5/1966 | Gropper | 15/209 |

*Primary Examiner*—Louis K. Rimrodt
*Attorney, Agent, or Firm*—Hopgood, Calimafde, Kalil, Blaustein & Lieberman

[57] ABSTRACT

The invention contemplates a scouring-pad construction wherein an outer tubular envelope is inside-out loosely knitted around a loosely fabricated pliant stuffer material, given lengths of such materials being secured to establish end closure along generally transverse alignments. In a preferred form, the inner and outer materials are both knitted, and thermoplastic filament is an important component of both knits, the ends being heat-sealed for permanent closure by local fusion of such filaments.

10 Claims, 10 Drawing Figures

Fig.1.
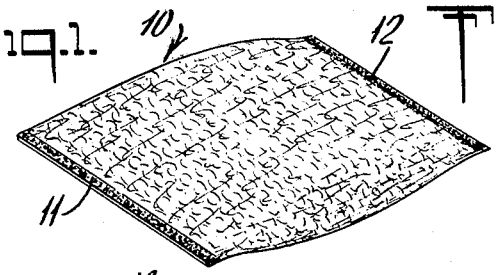
Fig.3.
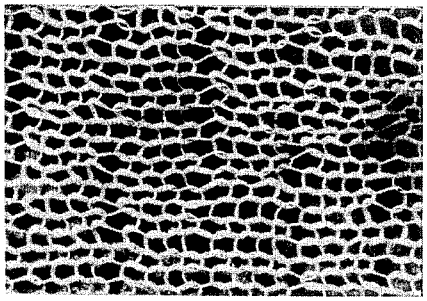
Fig.2.
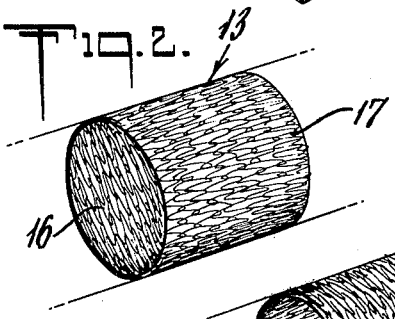
Fig.5.
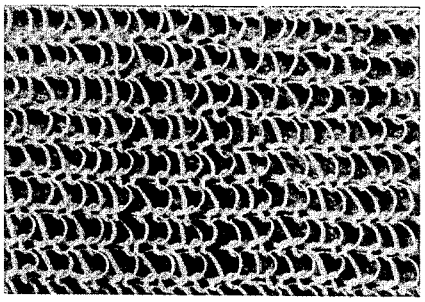
Fig.4.
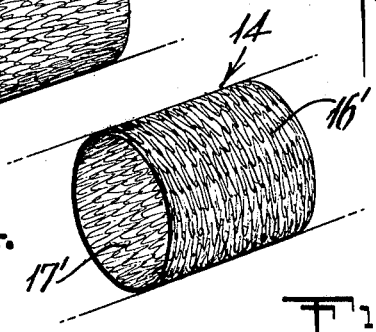
Fig.6.
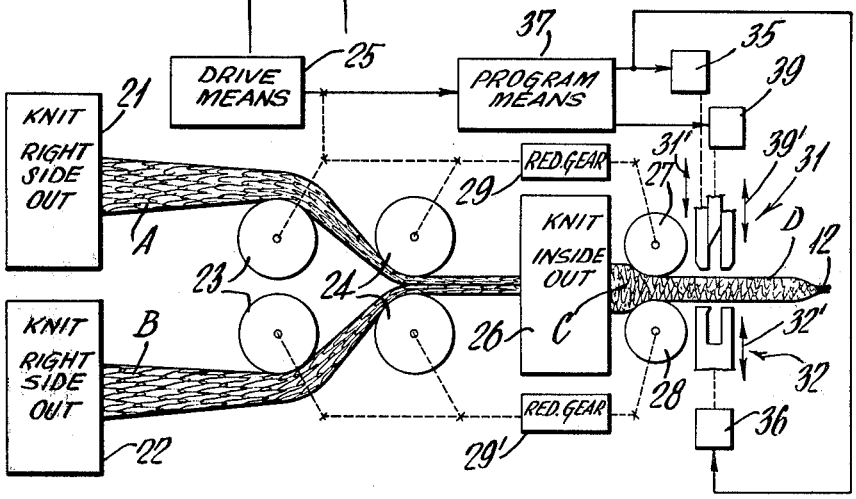
Fig.8.
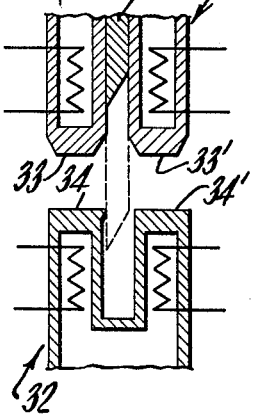
Fig.7.
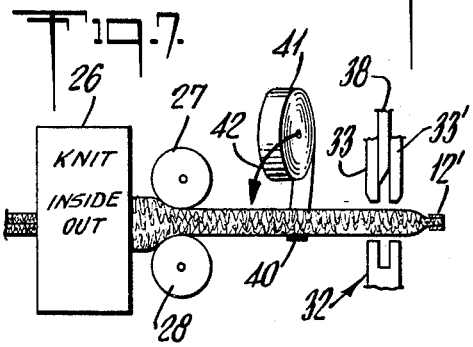
Fig.9.
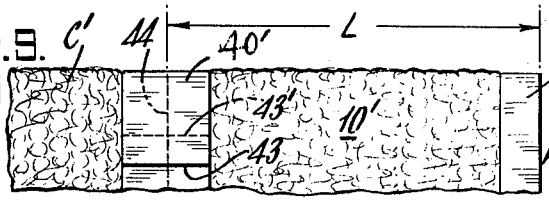
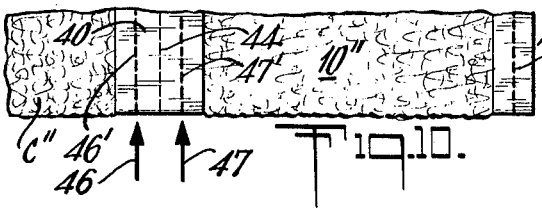
Fig.10.

METHOD OF MAKING A SCOURING PAD OR THE LIKE

The invention relates to an improved scouring-pad or the like construction and method of making the same.

It is an object to provide such an improved construction and method for continuous construction by knitting-machine techniques.

Another object is to provide an improved scouring-pad construction which does not require the separate handling step of inserting a stuffer material into a pliant outer envelope.

A further object is to provide such a construction and method whereby the material of a continuously knitted component can serve to effect bonded closure of ends of the construction.

A specific object is to meet the above objects with a construction and method whereby maximum use can be made of knitting techniques and whereby the completed end article may be derived by simple cut-off at predetermined longitudinal intervals of a continuously produced elongated pad assembly.

A general object is to meet the above objects with a superior structure at reduced cost, and requiring no manual assembly operations or secondary operations, once each article is severed from a continuously produced length.

Other objects and various further features of novelty and invention will be pointed out or will occur to those skilled in the art from a reading of the following specification, in conjunction with the accompanying drawings. In said drawings, which show, for illustrative purposes only, a preferred method and embodiment:

FIG. 1 is a perspective view of a pad of the invention;

FIG. 2 is a perspective view of a short length of knitted material in inside-out orientation, and constituting the outer envelope of the pad of FIG. 1;

FIG. 3 is an enlarged photograph of a fragmentary area of the exposed face of the knitted length of FIG. 2;

FIGS. 4 and 5 correspond to FIGS. 2 and 3 for the case of right-side out orientation of the knitted tube;

FIGS. 6 and 7 are simplified diagrams to illustrate fabrication steps in the method of the invention, FIG. 7 being fragmentary to illustrate a modification;

FIG. 8 is a fragmentary enlarged sectional view of bonding and cut-off elements of FIG. 6; and FIGS. 9 and 10 are like fragmentary plan views of product of the method, at the stages of bonding and cut-off.

In FIG. 1, the invention is shown in application to a scouring or the like pad 10 comprising an outer envelope which is a predetermined length of loosely knitted plain-knit tubular material in inside-out orientation. The longitudinal ends 11–12 of this length are closely and permanently bonded along local generally transversely extending alignments, and a loosely fabricated stuffer material, which may be one or more predetermined lengths of loosely knitted tubular material, is retained within the outer envelope. The filamentary material used in the outer envelope may be of metal or of a thermoplastic such as polypropylene, or the outer envelope may be a combination of such filamentary materials; such use of filamentary materials may also characterize the inner length or lengths of stuffer material. Preferably, however, maximum use is made of the thermoplastic filament, and highly satisfactory products are made solely of filamentary polypropylene.

FIG. 2 shows an illustrative length 13 of inside-out oriented loosely knit material, preferred for the outer element of the pad of FIG. 1. This material is preferably knit in inside-out orientation and FIG. 2 will therefore be understood to represent part of the continuously produced output of a suitably set-up conventional plain-knit machine. In FIG. 2, the "right side" or "face" is identified 16, being inwardly facing, and the "reverse side" is identified 17 and is outwardly facing; this reverse side 17 appears in the photograph of FIG. 3. For further identification, the "grain" of the face 16 is shown to be characteristically longitudinal, i.e., as a circumferentially spaced array of longitudinally oriented rib features. In contrast, the outwardly exposed "reverse side" 17 is characterized by predominantly circumferentially extending rib features in nested and axially spaced array. Upon closure of the ends 11–12, therefore, it is the latter circumferentially extending rib features which are directly exposed for scouring action, in use of the completed product.

In similar fashion, I show in FIG. 4 an illustrative length 14 of knitted material which may be as described for the length of FIG. 2, but which is constructed right-side out, so that the "face" 16′ (see FIG. 5) is externally exposed and the "reverse" side 17′ is internally facing. The length 14 is thus characterized by an externally exposed longitudinal grain, and by using the length 14 as stuffer material within the length 13, the longitudnal-grain faces 16–16′ of these lengths are placed in close, abutting adjacency, thus affording an important degree of mechanical interlock or keying, effective to restrain relative angular displacement of assembled lengths 13–14, in scouring-pad use. This mechanical-interlock feature is characteristic of the assembly, however many tubular lengths 14 are assembled in parallel side-by-side compressionally flattened adjacency within the outer envelope 13.

FIG. 6 schematically illustrates apparatus making maximum use of conventional plain-knit knitting machines for mass-production of pads as in FIG. 1, and for the illustrative case of using two parallel stuffer tubes of the FIG. 3 variety, within an outer envelope of the FIG. 2 variety. First and second parallel knitting machines 21–22 are each set-up to produce like continuous pliant plain-knit tubular outputs of stuffer material, respectively designated A–B and each is described at 14. First and second sets of feeder rolls 23–24 are synchronously and continuously driven by suitable means 25, to flatten both tubes and to bring them into side-by-side adjacency as they enter a third tubular knitting machine 26. This third machine 26 generates the outer envelope material 13 and is therefore set-up to produce an "inside-out" orientation of its tubular output C, it being understood that the output C is generated continuously around the flattened, continuously advancing stuffer material A–B. Output feed rolls 27–28 compress the outer tubular material upon the flattened stuffer plies A–B, for bonding and closure at pad-spaced intervals, as will be explained. Reduction-gear means at 29–29′ in the synchronous drive connections to rolls 27–28 will be understood to so control longitudinal stretch and therefore "neck-down" of plies A–B, in relation to an absence of stretch in envelope C, that the inner surface of envelope C agreeably accomodates the combined local peripheral extent of plies A–B as they become enshrouded by envelope C.

As previously indicated, at least some and preferably all of the filamentary construction of the knit is thermoplastic, thus enabling bonded closure of ends 11–12 by local application of heat at preselected longitudinal pad-defining intervals of the generally flattened product D of knitting-machine operation. The work-contacting elements of suitable apparatus to accomplish this function are shown generally in FIG. 6 and in greater detail in FIG. 8.

Briefly, for the form shown, upper and lower opposed electrically heated bonding-die elements 31–32 are disposed on opposite sides of the flattened knitted assembly D, it being understood that the outer projecting end 12 of assembly D will always have been bonded along edge 12, by reason of the next-preceding cycle of operation. Each die element includes two longitudinal spaced feet 33–33' (for elements 31) and 34–34' (for element 32), the corresponding feet 33–34 and 33'–34' to be brought into squeezing register with each other in their cooperative compressional action on assembly D, the action extending across the full transverse extent of assembly D and local to a first region to define the bonded trailing end 11 of one pad 10 and to slightly spaced but correspondng and parallel second such region to define the bonded leading end 12 of the next-succeeding such pad. Thus, die-head elements 31–32 will be understood to be guided for opposite reciprocated registering displacement, suggested by double arrows in FIG. 6, and to be suitably actuated by means 35–36 under the parallel-connected control of program means 37 having a synchronizing connection to the drive means 25. It will be understood, that depending upon the thickness and material of assembly D, the squeezing time and pressure, and the heated extent of die-head elements 31–32 will be set to accomplish local fusion of thermoplastic filaments, to retain the closed end edges 11–12. Also, during such application of heat and pressure, a cut-off knife element 38, reciprocably guided by part of the upper die-head element, is actuated by means 39, from its retracted upper position to its extended cut-off position 38', to sever a pad 10 between the foot alignments 33–34 and 33'–34'. A double-headed arrow 39 ' suggests such knife reciprocation, also under coordinated control by program means 37.

FIG. 7 shows a modified heat-sealing technique for permanent end-closure of severed pad products, involving a peripheral wrap 40 of thermoplastic ribbon or tape, such as commercially available vinyl tape (for example, of 1-inch width), at pad-length intervals. The tape wrap 40 is supplied from a reel 41 which will be understood to be suitably supported at a location offset from the continuously advancing knitted-tube assembly, and to be periodically subjected to an orbital path of movement about the knitted-tube assembly, as suggested by the arcuate heavy arrow 42. Tape wrap 40 may be developed at region C, i.e., prior to the flattening step at 27–28', but I prefer to develop wrap 40 after such flattening and prior to heat-sealing and cut-off by means 31–32. It will be understood that the tape-wrap and cut-off functions are suitably synchronized with continuous advance of the knitted-tube assembly, as by slide-mounting both reel 41 (and its gyrating support mechanism, suggested at 42) and the heat-seal and cut-off means 31–32 at pad-length spacing, and longitudinally reciprocating the slide mounting such that a forward stroke thereof matches the feed speed of the knitted-tube assembly, thereby allowing tape-wrap, heat-sealing and cut-off to proceed in accurate register for each severed product.

FIG. 9 shows the final steps of FIG. 7 in terms of the product alone. The advancing knitted-tube assembly (designated C') is shown with an applied tape wrap 40 having overlapped ends 43–43' and so positioned with respect to the previously cut-off end 12' that the design product-length interval L establishes a next cut-off alignment 44 at the longitudinal center of wrap 40. By the time wrap 40 reaches the cut-off station, the heat-sealing feet 33–34 and 33'34' will register with wrap 40 and will also place knife 38 in the central cut-off alignment 44. The final step induces fusion of tape material to itself and to the adjacent polypropylene filaments of compressed knit material, while cutting the tape wrap 40 in half to form a banded end margin at 45.

FIG. 10 illustrates further modification as to the final steps of bonding and cut-off, wherin stitching as with polypropylene filament is relied upon to secure the pad ends 11–12, using two spaced stitching heads (suggested by heavy arrows 46–47) at opposite longitudinal offsets from the cut-off alignment 44. The stitching heads will be understood to be supported for transverse reciprocation, across the knitted-tube assembly, and to be slide-mounted for intermittent longitudinal coordination with the continuous advance of the knitted-tube assembly, as in the case of the tape-applying mechanism of FIG. 7. Resulting stitch seams are indicated at 46'–47' and may be applied directly to the knitted-tube assembly, after flattening compression by rolls 27–27'; however, I indicate a preference to apply the stitching over a tape band 40 which may or may not be of thermoplastic material. For the case of a 1-inch wide tape wrap 40, the stitched seams may be at ½ to ¾-inch spacing; and if no tape wrap is employed, the stitching alignments 46'–47' are preferably in the order of ¾-inch apart.

It will be understood that the mechanism for applying tape 40' may be as described for tape 40 in FIG. 9, except that if slide-mounted with stitching means 46–47 and cut-off means 31–32, the tape-applying means should be longitudinally offset at least to the extent of an integer multiple of the pad length L, from stitching means 46–47. Of course, if band 40' is thermoplastic, as in the case of band 40 in FIG. 9, the final heat-sealing step will have been additionally secured and reinforced by the stitching.

The described structure and methods of making the same will be seen to have met all stated objects. A uniform and superior product 10 (10', in FIG. 9; 10'', in FIG. 10) is mass-produced without manual intervention, using conventional plain-knit machines and techniques. In the use of polypropylene filamentary material throughout the knitting process, I have found satisfactory and therefore prefer a ribbon-like filament which is commercially available from ACS Industries, Inc., Woonsocket, R.I. Such polypropylene monofilament has a generally elliptical section characterized by a minor/major extent of 0.009-inch/0.030-inch. The tubular components are loosely woven, and it is found adequate to rely upon random orientation of the elliptical section in the course of knitting, to obtain a satisfactory end product, as of the approximate overall dimensions 3-6½inches wide by 5 inches long.

While the invention has been described in detail for preferred forms and methods, it will be understood that modification may be made without departing from the spirit and scope of the invention.

What is Claimed is:

1. The method of making a scouring pad or the like which comprises loosely knitting an elongate pliant outer tube around a loosely knitted elongate pliant inner tube of stuffing material, one of said tubes being inside-out knitted with respect to the other, whereby the grain of adjacent surafaces of said tubes may be in essentially the same predominant direction, locally compressing the outer tube upon the stuffing material at longitudinally spaced locations to define first and second transversely extending end alignments of a pad, locally securing the compressed materials at said alignments, such securing including the step of stitching separate seams along said end alignments, and severing individual pads thus end-secured.

2. The method of claim 1, in which the knitted material of the outer tube is substantially entirely of thermoplastic filaments.

3. The method of claim 2, in which the thermoplastic filaments are of polypropylene.

4. The method of claim 1, in which said outer tube is inside-out knitted.

5. The method of claim 1, in which the inner knitted tube is one of a plurality of like inner tubes within the outer tube.

6. The method of claim 1, in which the knitted material of the outer tube includes a filamentary metal element.

7. The method of claim 1, in which the knitted material of the inner element includes a filamentary metal element.

8. The method of claim 1, in which the inner tube is continuously knitted and in which the outer tube is continuously knitted around the continuous output of inner-tube knitting.

9. The method of claim 1, in which a ribbon wrap is applied at pad-length intervals around the outer tube, 10. The method of making a scouring pad or the like which compresses loosely knitting an elongate pliant outer tube around a loosely knitted elongate pliant inner tube of stuffing material, one of said tubes being inside-out knitted with respect to the other, whereby the grain of adjacent surfaces of said tubes may be in essentially the same predominant direction, locally compressing the outer tube upon the stuffing material at longitudinally spaced locations to define first and second transversely extending end alignments of a pad, locally securing the compressed materials at said alignments, and severing individiual pads thus end-secured, the effective longitudinal extent of the secured region at each such alignment extending on opposite sides of the alignment of severance, and the securing including the step of stitching separate seams on opposite sides of the alignment of severance, thus establishing two closely adjacent secured regions which are respectively on longitudinally opposite sides of the alignment of severance.

* * * * *